US012133584B2

(12) United States Patent
Debenedictis et al.

(10) Patent No.: US 12,133,584 B2
(45) Date of Patent: Nov. 5, 2024

(54) HAIR STYLING DEVICE

(71) Applicant: JAPHAM GROUP LIMITED, Kempston (GB)

(72) Inventors: Alfredo Debenedictis, Birmingham (GB); Janusz Lucien Holland, Birmingham (GB); Mark Christopher Hughes, Birmingham (GB); Martin Malcolm Harris, Birmingham (GB); James Robert Nelson, Birmingham (GB); Suraj Soren, Birmingham (GB)

(73) Assignee: JAPHAM GROUP LIMITED, Kempston (GB)

( * ) Notice: Subject to any disclaimer, the term of this patent is extended or adjusted under 35 U.S.C. 154(b) by 478 days.

(21) Appl. No.: 17/432,323

(22) PCT Filed: Feb. 24, 2020

(86) PCT No.: PCT/EP2020/054791
§ 371 (c)(1),
(2) Date: Aug. 19, 2021

(87) PCT Pub. No.: WO2020/169849
PCT Pub. Date: Aug. 27, 2020

(65) Prior Publication Data

US 2023/0132429 A1 May 4, 2023

(30) Foreign Application Priority Data

Feb. 22, 2019 (GB) ..... 1902443

(51) Int. Cl.
*A45D 2/00* (2006.01)
*A45D 1/06* (2006.01)
(Continued)

(52) U.S. Cl.
CPC ..... *A45D 1/06* (2013.01); *A45D 20/12* (2013.01); *A45D 2001/002* (2013.01); *A45D 2200/00* (2013.01)

(58) Field of Classification Search
CPC ... A45D 1/00; A45D 1/06; A45D 1/08; A45D 2/36; A45D 20/12; A45D 2001/002
See application file for complete search history.

(56) References Cited

U.S. PATENT DOCUMENTS 1,494,507 A 5/1924 Ruffio
1,609,810 A 12/1926 Gates
(Continued)

FOREIGN PATENT DOCUMENTS

CN 108813896 A 11/2018
CN 208339131 U 1/2019
(Continued)

OTHER PUBLICATIONS

Steenbeck, L. J., "Third Party Observations (Article 115 EPC)", Jun. 29, 2016, pp. 1-5.
(Continued)

*Primary Examiner* — Rachel R Steitz
(74) *Attorney, Agent, or Firm* — HULTQUIST, PLLC; Steven J. Hultquist

(57) ABSTRACT

The invention relates to a hair styling device, and in particular a multifunctional hair styling device having components which can carry out a number of different (and distinct) styling operations. The invention provides a hair styling device having a body portion and a handle portion, the body portion having an air inlet and an air outlet, an impeller between the air inlet and the air outlet and an electric motor to rotate the impeller, the handle portion having a pair of heating panels. The handle portion is separable from the body portion and can be used alone as a
(Continued)

hair straighter, or the device can be used as a hair dryer with the handle portion attached to the body portion. The body portion can optionally include a hair curling chamber adapted for hair curling.

26 Claims, 7 Drawing Sheets

(51) Int. Cl.
*A45D 20/12* (2006.01)
*A45D 1/00* (2006.01)

(56) References Cited

U.S. PATENT DOCUMENTS

| | | | |
|---|---|---|---|
| 1,636,967 | A | 7/1927 | Perry |
| 1,701,270 | A | 2/1929 | Moskovitz et al. |
| 1,709,981 | A | 4/1929 | Headington |
| 1,806,711 | A | 5/1931 | Salzman |
| 1,814,116 | A | 7/1931 | Borden |
| 1,827,785 | A | 10/1931 | Frederics |
| 1,831,487 | A | 11/1931 | Elam |
| 1,877,776 | A | 9/1932 | Pezzella |
| 1,884,305 | A | 10/1932 | Shelton |
| 1,894,624 | A | 1/1933 | Marcel |
| 1,895,653 | A | 1/1933 | Fisher |
| 1,951,154 | A | 3/1934 | Klein |
| 1,981,362 | A | 11/1934 | Joyce |
| 1,997,690 | A | 4/1935 | Katcher |
| 2,197,821 | A | 4/1940 | Webster |
| 2,593,544 | A | 4/1952 | Davis et al. |
| 2,595,844 | A | 5/1952 | Graham |
| 2,791,225 | A | 5/1957 | Simmons |
| 2,867,223 | A | 1/1959 | Anzalone |
| 2,906,272 | A | 9/1959 | Heidel |
| 2,935,070 | A | 5/1960 | Auz |
| 3,213,859 | A | 10/1965 | Mizell et al. |
| 3,213,860 | A | 10/1965 | Mizell et al. |
| 3,223,093 | A | 12/1965 | Winters |
| 3,255,765 | A | 6/1966 | Sturdivant |
| 3,605,762 | A | 9/1971 | Fromann |
| 3,786,819 | A | 1/1974 | Cantrell |
| 3,805,810 | A | 4/1974 | Savala |
| 3,835,292 | A | 9/1974 | Walter et al. |
| 3,894,547 | A | 7/1975 | Scivoletto |
| 3,968,805 | A | 7/1976 | Sobeck, Jr. |
| 4,148,330 | A | 4/1979 | Gnaga |
| 4,177,824 | A | 12/1979 | Gnaga |
| 4,222,398 | A | 9/1980 | Fromman |
| 4,342,323 | A | 8/1982 | Rick et al. |
| 4,603,246 | A | 7/1986 | Giancario |
| 4,829,156 | A | 5/1989 | Thompson |
| 4,884,583 | A | 12/1989 | Long, Jr. |
| 5,119,847 | A | 6/1992 | Powell et al. |
| 5,133,372 | A | 7/1992 | Seja et al. |
| 5,323,792 | A | 6/1994 | Caruso |
| 5,327,919 | A | 7/1994 | Hanlon |
| 5,472,003 | A | 12/1995 | Frame et al. |
| 5,584,309 | A | 12/1996 | De Beneditis et al. |
| 5,771,906 | A | 6/1998 | De Benedictis |
| 5,813,419 | A | 9/1998 | Brams |
| 5,899,213 | A | 5/1999 | Kimata |
| 6,386,206 | B2 | 5/2002 | Lee |
| 6,637,441 | B2 | 10/2003 | Kennedy et al. |
| 6,647,989 | B1 | 11/2003 | De Benedictis |
| 6,962,159 | B1 | 11/2005 | Adam |
| 7,121,285 | B2 | 10/2006 | Kraus |
| 7,198,049 | B2 | 4/2007 | Elmer et al. |
| 7,305,995 | B2 | 12/2007 | Tojo et al. |
| 7,487,783 | B2 | 2/2009 | Saito et al. |
| 7,500,487 | B2 | 3/2009 | Kobayashi et al. |
| 7,513,259 | B2 | 4/2009 | Kimata et al. |
| 7,770,586 | B2 | 8/2010 | Tojo et al. |
| 7,789,093 | B2 | 9/2010 | Tojo et al. |
| 8,132,575 | B2 | 3/2012 | Tojo et al. |
| 8,256,438 | B2 | 9/2012 | Tojo et al. |
| 8,448,651 | B2 | 5/2013 | Honnefeller et al. |
| 8,607,804 | B2 | 12/2013 | De Benedictis |
| 8,651,118 | B2 | 2/2014 | De Benedictis et al. |
| 8,733,374 | B2 | 5/2014 | De Benedictis et al. |
| 8,869,808 | B2 | 10/2014 | De Benedictis |
| 9,027,570 | B2 | 5/2015 | De Benedictis et al. |
| 9,138,039 | B2 | 9/2015 | De Benedictis et al. |
| 9,185,957 | B2 | 11/2015 | Richmond et al. |
| 9,345,302 | B2 | 5/2016 | Chung |
| 9,615,643 | B2 | 4/2017 | De Benedictis et al. |
| 9,615,644 | B2 | 4/2017 | De Benedictis et al. |
| 9,629,434 | B2 | 4/2017 | DeBenedictis et al. |
| 9,788,625 | B2 | 10/2017 | DeBenedictis et al. |
| 9,854,891 | B2 | 1/2018 | De Benedictis et al. |
| 10,238,196 | B2 | 3/2019 | DeBenedictis |
| 10,485,317 | B2 | 11/2019 | DeBenedictis et al. |
| 10,772,406 | B2 | 9/2020 | DeBenedictis et al. |
| 2004/0231689 | A1 | 11/2004 | Kobayashi et al. |
| 2004/0231690 | A1 | 11/2004 | De Benedictis |
| 2004/0237991 | A1 | 12/2004 | Glucksman et al. |
| 2005/0241663 | A1 | 11/2005 | Getahun |
| 2005/0268933 | A1 | 12/2005 | Kimata et al. |
| 2005/0284493 | A1 | 12/2005 | Allen |
| 2006/0124148 | A1 | 6/2006 | Tojo et al. |
| 2006/0157078 | A1 | 7/2006 | Tojo et al. |
| 2007/0017541 | A1 | 1/2007 | Wilmore |
| 2007/0065489 | A1 | 3/2007 | Tojo et al. |
| 2007/0068547 | A1 | 3/2007 | Gurth et al. |
| 2007/0084479 | A1 | 4/2007 | Ryan-Jakimas |
| 2008/0035167 | A1 | 2/2008 | Chan |
| 2008/0236610 | A1 | 10/2008 | Bartels |
| 2008/0302381 | A1 | 12/2008 | Tojo et al. |
| 2009/0056738 | A1 | 3/2009 | Tojo et al. |
| 2010/0083978 | A1 | 4/2010 | Hottenrott et al. |
| 2010/0170883 | A1 | 7/2010 | Legrain et al. |
| 2010/0263684 | A1 | 10/2010 | De Benedictis |
| 2011/0220141 | A1 | 9/2011 | Chan |
| 2012/0186601 | A1 | 7/2012 | Ungar et al. |
| 2013/0025621 | A1 | 1/2013 | De Benedictis |
| 2013/0125919 | A1 | 5/2013 | De Benedictis et al. |
| 2013/0263882 | A1 | 10/2013 | Kim et al. |
| 2014/0076351 | A1 | 3/2014 | De Benedictis et al. |
| 2014/0216494 | A1 | 8/2014 | De Benedictis et al. |
| 2015/0000689 | A1 | 1/2015 | De Benedictis |
| 2015/0114425 | A1 | 4/2015 | Park |
| 2015/0128987 | A1 | 5/2015 | De Benedictis et al. |
| 2015/0201727 | A1 | 7/2015 | De Benedictis et al. |
| 2015/0216281 | A1 | 8/2015 | De Benedictis et al. |
| 2016/0255937 | A1 | 9/2016 | De Benedictis et al. |
| 2016/0353853 | A1 | 12/2016 | De Benedictis et al. |
| 2017/0006989 | A1 | 1/2017 | DeBenedictis et al. |
| 2017/0172273 | A1 | 6/2017 | Kock et al. |
| 2018/0020796 | A1 | 1/2018 | DeBenedictis et al. |
| 2018/0220766 | A1 | 8/2018 | De Sars et al. |
| 2018/0228262 | A1 | 8/2018 | Bonnemaire et al. |
| 2018/0233788 | A1* | 8/2018 | Goldman ..... H01M 50/213 |
| 2019/0053595 | A1 | 2/2019 | DeBenedictis |
| 2021/0022468 | A1 | 1/2021 | DeBenedictis et al. |

FOREIGN PATENT DOCUMENTS

| | | | |
|---|---|---|---|
| DE | 172581 | C | 2/1905 |
| EP | 434713 | | 9/1911 |
| EP | 1417906 | A1 | 5/2004 |
| EP | 2392222 | A1 | 12/2011 |
| FR | 641097 | A | 7/1928 |
| FR | 38041 | A | 3/1931 |
| FR | 2310105 | A1 | 11/1976 |
| FR | 2937839 | A1 | 5/2010 |
| FR | 434713 | | 9/2011 |
| GB | 303043 | A | 12/1928 |
| GB | 1036583 | A | 7/1966 |
| GB | 1157814 | A | 7/1969 |
| GB | 302952 | A | 12/1978 |
| GB | 2413492 | A | 11/2005 |
| JP | S60140502 | U | 9/1985 |
| JP | 61-10102 | U | 1/1986 |
| JP | S6278801 | U | 5/1987 |

(56) References Cited

FOREIGN PATENT DOCUMENTS

| | | | |
|---|---|---|---|
| JP | S633808 | A | 1/1988 |
| JP | 2002520076 | A | 7/2002 |
| JP | 2005324073 | A | 11/2005 |
| KR | 1020170055290 | A | 11/2017 |
| KR | 1020170109307 | A | 11/2017 |
| KR | 101894759 | B1 | 8/2018 |
| WO | 0008967 | A1 | 2/2000 |
| WO | 2005082198 | A1 | 9/2005 |
| WO | 2008102317 | A2 | 8/2008 |
| WO | 2008132345 | A2 | 11/2008 |
| WO | 2009077747 | A2 | 6/2009 |

OTHER PUBLICATIONS

Van Der Scheer, Robbert, "Correspondence Concerning Investigation of Rowenta Curl Active, Model CF 6510 Product", Jun. 29, 2016, pp. 1-2.

* cited by examiner

HAIR STYLING DEVICE

CROSS-REFERENCE TO RELATED APPLICATIONS

This is a United States national phase under 35 USC § 371 of International Patent Application PCT/EP2020/054791 filed Feb. 24, 2020, which in turn claims priority under 35 USC § 119 of United Kingdom Patent Application No. 1902443.9 filed Feb. 22, 2019. The disclosures of all such applications are hereby incorporated herein by reference in their respective entireties, for all purposes.

FIELD OF THE INVENTION

The invention relates to a hair styling device, and in particular a multifunctional hair styling device.

As will be explained below, the hair styling device is multifunctional in that it has components which can carry out a number of different (and distinct) styling operations, for example hair straightening, hair curling and hair drying. Certain embodiments can be used for multiple operations at the same time, for example curling and drying, but the invention also includes embodiments which can be used for only a single operation at a time so that if different styling operations are required they are undertaken sequentially.

For convenience, the following specification will refer to the use of the device for styling a woman's hair, but the invention can also be used by men.

BACKGROUND TO THE INVENTION

It has long been desired to style a woman's hair, i.e. to add waves or curls to naturally straight hair or to straighten naturally wavy or curly hair. To style hair it is necessary to modify some of the chemical bonds which give the hair its natural form. The chemical bonds can be modified chemically with a perming solution, or mechanically—usually through the application of heat and/or pressure.

Many different types of hair styling device are known and available on the market.

A first type of hair styling device is a hair dryer. A hair dryer creates a stream of heated air which the user can direct towards a chosen section of hair. The section of hair can be styled as it is dried and heated by the air stream (with for example the section of hair being wound around a styling brush or the like). Many hair dryers can also create a stream of unheated (or ambient) air which can be used in some styling operations.

Some hair dryers include a nozzle attachment which can be fitted to the air outlet to create a more concentrated stream of air. Some hair dryers include a diffuser attachment which can be fitted to the air outlet to create a more diffuse stream of air. It is a particular feature of a diffuser that it has a large number of air outlets distributed over a relatively large area. This enables a chosen section of hair to be dried without being blown about, as is desirable for some hair styles.

A second type of hair styling device is a hair straightener. Hair straighteners are a particular form of hair styling device which use heat and pressure to style the hair. Hair straighteners were originally referred to as "straightening irons" to reflect the fact that they replicate the action of ironing the hair, i.e. pressing the hair between a heated "iron" and a flat surface.

Most hair straighteners comprise a pair of arms which are hinged relative to one another, each arm carrying a heating panel. The heating panels are usually heated electrically by way of one or more electrical heating element(s) for each panel. With the arms in their open condition the user inserts the proximal or scalp end of a chosen section of hair between the panels and then presses the arms together so that the section of hair is pressed between the heating panels. The hair straightener is then moved away from the scalp and the section of hair is heated and pressed as it is pulled between the panels.

To straighten the section of hair the arms are oriented so that the heating panels are substantially perpendicular to the scalp and the section of hair is pulled in a substantially linear direction between the panels. It is also possible, however, to use a hair straightener to add a wave to the section of hair by orienting the arms relative to the scalp so that the hair is forced to bend around a relatively sharp edge as it leaves the heating panels.

The heat and pressure applied by the heating panels also acts to flatten the cuticle of the hair. Whilst hair is naturally substantially circular in cross-section, flattening the cuticle (and thereby flattening the cross-section) can increase the reflection from the hair and enhance the sheen upon the hair. Many users believe that hair straighteners make their hair look more healthy because of the increased sheen achieved by flattening the cuticle.

Hair crimpers and hair wavers can be considered as derivations of the second type of hair styling device. In these devices the flat heating panels are replaced by corrugated heating panels. The section of hair is pressed between the corrugated heating panels and adopts the crimped or wavy form of the corrugations. The section of hair is not pulled between the panels in a continuous styling operation as with hair straighteners, but instead the panels press selected portions of the section of hair sequentially, styling each portion before being moved to another portion.

A third type of hair styling device is an automated hair curler. Automated hair curlers have a rotatable element which captures or collects a section of hair to be styled and winds the section of hair around an elongate member. The preferred embodiments utilise a heated chamber surrounding the elongate member. The section of hair inside the chamber becomes styled by the application of heat whilst it is coiled around the elongate member. Patent applications WO 2009/077747, WO 2012/080751, WO 2013/186547, U.S. Pat. Nos. 2,906,272, 2,935,070 and 4,177,824 describe various designs of automated hair curlers.

Some multifunctional hair styling devices are also known. Patent application WO 2015/132594 for example describes a hair styling device which can be used as an automated hair curler or as a hair straightener, as desired.

Chinese patent application CN 105 942 698 can also be considered as a multifunctional hair styling device notwithstanding that each function utilises a stream of heated air. This document discloses a modified hair dryer having two arms along which the heated air is passed. The arms can be moved together or apart to vary the styling operation, and also the heated air can pass out of the arms through two relatively large end holes or through a large number of relatively small side holes. Firstly, when the arms are moved together with the end holes open a relatively concentrated stream of heated air is provided somewhat like a conventional hair dryer. Secondly, when the arms are moved together with the side holes open, heated air is blown through the multiple side holes onto a section of hair located between the arms. Thirdly, when the arms are moved apart with the side holes open a relatively diffuse stream of heated air passes out of the side holes.

A further multifunctional hair styling device comprises a handle which can be selectively connected to a hair straightener (with a pair of hinged heating panels), or to a hair dryer (with a motor, impeller and heater for creating a stream of heated air), or to a hair curler (with a rotatable element to wind a length of hair around an elongate member). The user can fit the appropriate attachment to the handle depending upon the hair styling operation desired, each styling operation being undertaken separately.

SUMMARY OF THE INVENTION

The inventors have sought to provide an alternative hair styling device which can be used to achieve a number of different styling operations. The styling operations can be undertaken either concurrently or sequentially on the same length of hair, or the user can utilise only some of the componentry of the device to carry out a particular styling operation and can utilise other componentry of the device to carry out a different styling operation at a different time.

According to the first aspect of the invention there is provided a hair styling device having a body portion and a handle portion, the body portion having an air inlet and an air outlet, an impeller between the air inlet and the air outlet and an electric motor to rotate the impeller, the handle portion having a pair of heating panels, the handle portion being separable from the body portion.

The body portion can provide a hair dryer with air passing from the air inlet to the air outlet and being blown out of the air outlet towards the user's head in use.

The handle portion provides a handle for the hair dryer when it is attached to the body portion, and also provides a hair straightener or the like when it is detached from the body portion.

Unlike the further multifunctional device described above, the heating panels are permanently fitted to the handle portion. This significantly improves the operation of the device when used for hair straightening as explained below, and also avoids the requirement for releasable electrical connections between the handle portion and the heating panels.

Whilst the first aspect (and other aspects below) refers to an impeller, it is recognised that the air flow could alternatively be generated by a fan or turbine. For brevity the term "impeller" will be used in this application to refer to any component which can be rotated by the motor and generate an air flow from the air inlet to the air outlet.

The handle portion may have two substantially planar heating panels as with a conventional hair straightener. Alternatively, the panels may be corrugated similarly to a hair waver. It is preferably arranged that the panels are mounted to respective arms which can move towards and away from each other, i.e. so that the arms can adopt a "closed" and an "open" condition respectively. Desirably the arms are connected together by way of a hinged joint. The hinged joint can be provided adjacent to an end of the handle portion, ideally the end opposed to the heating panels, similar to conventional hair straighteners. As with conventional hair straighteners also, in the open condition a section of hair can be introduced into the gap between the heating panels; in the closed condition the section of hair can be heated between the heating panels to style the section of hair.

Preferably each of the arms of the handle portion comprises a heating panel and a covering part which covers and largely obscures the heating panel in use. In known fashion, the covering part is ideally of plastic or other material which is a poor conductor of heat so that the user is able to touch the covering part without being burned even when the heating panels are at their operating temperature. Desirably, the covering part has a number of surface deformations (for example ribs, dots or other formations) which allow air to flow around the contact regions, which increase the surface area of the covering part and which act to dissipate heat into the surrounding environment more rapidly than a smooth surface, whereby to reduce the contact temperature of the covering part during use.

With conventional hair straighteners the user typically grips the arms in a region between the hinge and the heating panels so that no part of her hand engages the covering part where it directly overlies a heating panel. The temperature of the arms where they are gripped by the user is reduced to a comfortable level firstly by the poor conduction of heat from each heating panel to the covering part directly overlying the heating panel, and secondly by the poor conduction of heat along the arm. With the present invention, however, when the handle portion is attached to the body portion it is expected that the user will grip the handle portion by way of the covering parts at a location directly overlying at least a part of the heating panels. During most periods of use with the handle portion attached to the body portion it is expected that the heating panels will not be hot but it is nevertheless possible that the device might be used by one person to straighten her hair and then shortly afterwards by another person to dry her hair. It therefore cannot be excluded that the present invention might be used with the handle portion being gripped whilst the heating panels are close to their operating temperature. Notwithstanding the use of a material which is a poor conductor of heat for the covering parts, the addition of surface deformations to dissipate heat will help to reduce the temperature of the covering parts and increase the user's comfort during such periods of use.

Alternatively or additionally, one or more additional thermal barriers can be located between the heating panel and the covering part of each arm whereby to further reduce the temperature of the covering part during use.

Desirably, the body portion has a mounting structure to which the handle portion can be attached. Preferably the mounting structure comprises a generally planar platform projecting from the remainder of the body portion. Desirably the mounting structure has an opening which is sized and shaped to accommodate the heating panels. Such an arrangement allows the heating panels to avoid direct contact with the platform or other parts of the mounting structure, which contact might cause damage or wear to the heating panels. It can be arranged that the heating panel of each arm engages the other heating panel in the opening but that is not necessary and it can instead be arranged that the heating panels are held a small distance apart by the mounting structure.

Preferably, the mounting structure has at least one protective formation adjacent to the opening. Desirably a protective formation is located adjacent to a side of the opening. Desirably also the protective formation is continuous and extends beyond the ends of the opening. Preferably there are two protective formations, each adjacent to a respective side of the opening.

Preferably each protective formation comprises a material which is a poor conductor of heat. Alternatively or additionally, each protective formation includes at least one thermal barrier. Accordingly, each protective formation acts to reduce the conduction of heat from the (hot) heating panels through the protective formation.

It is arranged that the protective formation(s) overlies and obscures a side edge of the heating panels when the handle portion is attached to the body portion. In this respect it will be appreciated that the side edges of the heating panels of conventional hair straighteners (and correspondingly the side edges of the heating panels of the handle portion of the present invention) are exposed and accessible when the arms are in the closed condition. The side edges are very hot during use and it is known that many users burn themselves by touching the exposed side edges. The provision of protective formation(s) which overlie and obscure the side edges reduces or avoids the risk of burns to the user by touching the side edge of a hot heating panel during attachment of the handle portion and also during use of the device with the handle portion attached to the body portion.

Desirably, the mounting structure comprises a fixed part and a movable part, the fixed part being fixed relative to the remainder of the body portion and the movable part being movable relative to the fixed part. Preferably the movable part is mounted to slide relative to the fixed part. Preferably also the opening is located in the movable part. In use, the handle portion can be fitted to the movable part and located relative to the movable part. The handle portion and the movable part can be moved together between a released position and a retained position relative to the fixed part. In the retained position the handle portion is securely attached to the mounting structure and thereby to the body portion.

The handle portion and movable part are preferably held in the retained position by a latch mechanism whereby movement of the handle portion and the movable part to the retained position automatically engages the latch mechanism and secures the handle portion. Preferably the latch mechanism includes a latch member which is mounted on the fixed part of the mounting structure and can releasably engage the movable part of the mounting structure. In such an arrangement the latch member does not engage any part of the handle portion. Preferably also there are two latch members which can releasably engage respective parts of the movable part of the mounting structure.

Desirably the mounting structure has two releasing buttons, one of the releasing buttons being connected to a respective latch member; it is desirably necessary for both of the releasing buttons to be actuated together in order to release the latch members and allow the handle portion and movable part to be moved to the released position.

Preferably, the movable part of the mounting structure and the handle portion have cooperating formations to ensure that these elements move together. Desirably the cooperating formations comprise at least one projection and a recess which can accommodate the projection. Desirably also the projection is located on the movable part and the recess is located on an arm of the handle portion.

Preferably, in common with a conventional hair dryer, the air is heated in the body portion on its path from the air inlet to the air outlet. Preferably the body portion has at least one heating element which is separate from the heating panels. Accordingly, when the device is used as a hair dryer the air is heated by the heating element of the body portion rather than by the heating panels of the handle portion.

Preferably also, when the handle portion is attached to the body portion the heating panels are located outside the body portion. In such embodiments therefore the heating panels play no part in heating the air in the body portion.

Alternatively (but less preferably), when the handle portion is attached to the body portion at least a part of the heating panels are located inside the body portion, and in particular are located in an air flow path between the air inlet and the air outlet. In such embodiments the heating panels of the handle portion can be used to heat the air as it passes through the body portion, perhaps in addition to heating element(s) in the body portion.

As above stated, when used for hair straightening the handle portion is separated from the body portion and used alone. In common with conventional hair straighteners it can be arranged that the heating panels engage each other when the arms are pressed together. Alternatively, it can be arranged that the heating panels do not engage but are rather held slightly apart when the arms are pressed together. Notwithstanding that in this latter arrangement the section of hair is not pressed or clamped between the heating panels, the application of heat alone can be used to remove some of the curl from naturally curly or wavy hair (so called "taming" or "smoothing" of the section of hair) which is desirable for some users.

In one embodiment the heating panels can be configured as described in WO 2019/238961 and the hair straightener can be used in the same way as described in that document.

Preferably, a nozzle attachment and/or a diffuser attachment is removably attachable to the body portion adjacent to the air outlet. In common with a conventional hair dryer the nozzle attachment can act to concentrate the air flow and assist the user in directing the air flow as desired. The diffuser attachment can also act conventionally in enabling a user to direct a relatively diffuse (and slower-moving) stream of air towards the user's hair.

Preferably, the body portion has a curling chamber, the curling chamber having a rotatable element and an elongate member, at least part of the rotatable element and at least part of the elongate member being in the curling chamber, the curling chamber having a primary opening through which a section of hair can pass into the chamber, the rotatable element being located adjacent to the opening and being shaped to pull the section of hair through the opening, the rotatable element winding the section of hair around the elongate member in use, the air in use flowing from the air inlet to the air outlet by way of the curling chamber. In these embodiments the body portion comprises an automated hair curler generally similar to that of WO2009/077747 for example. The embodiments differ from the prior art arrangements, including the multifunctional tool of WO2015/132594, in providing a separable handle portion which can be separated from the body portion and function as a hair straightener.

In these embodiments the air flows from the air inlet to the curling chamber before leaving the curling chamber by way of the air outlet. The air can if desired be heated before entering the curling chamber. Even if the air is not heated, however, the flow of air into the curling chamber can assist the styling operation (whether the hair is initially dry or damp).

Desirably, the curling chamber has a secondary opening through which the section of hair can pass out of the curling chamber, for example at the end of a styling operation. Desirably also the elongate member has a free end. A movable abutment can be located adjacent to the free end and to the secondary opening, the movable abutment having a closed position in which the section of hair is retained in the curling chamber and an open position in which the section of hair can move off the free end of the elongate member and pass out of the curling chamber. The movable abutment in its closed position preferably also prevents the section of hair from passing around the free end of the elongate member and being twisted rather than curled by the rotation of the rotatable element.

Such a curling chamber, elongate member and movable abutment are described in WO2012/080751 and the detailed structure of these elements can match the components described in this prior art document if desired. However, it is preferred that the movable abutment in the closed position spans a large proportion of the secondary opening so that it also functions to limit the escape of air from the curling chamber. Ideally the movable abutment spans at least 50% of the area of the (open) secondary opening, and ideally spans around 70% of the area of the secondary opening. This is particularly valuable in embodiments in which the air is heated, the movable abutment helping to ensure that the heated air is retained in the curling chamber for longer so that the section of hair is heated more quickly and/or more thoroughly.

Preferably the electric motor to rotate the impeller is a first electric motor and the body portion has a second electric motor to rotate the rotatable element. Alternatively a single motor can rotate the impeller and the rotatable element. Two motors are however preferred as that makes the device more useful for drying hair in the curling chamber. In particular, in common with the prior art arrangements the rotation of the rotatable element can be stopped when all of the section of hair has been wound around the elongate member but it is desirable to maintain a heated air flow into the curling chamber until the hair is dry.

Preferably, the air enters the curling chamber by way of a number of openings or perforations in the elongate member. In use, air flow through the perforations in the elongate member (whether or not the air is heated, and whether or not the hair is dry or damp) will act to push the section of hair away from the elongate member, especially at the end of the winding operation when all of the section of hair has been wound around the elongate member. Thus, it is recognised that an outflow of air from the elongate member can assist the outwards movement of the section of hair into engagement with the chamber wall and can better ensure that all of the sections of hair are consistently styled.

The outer wall or walls of the curling chamber can if desired also be perforated. Openings or perforations in the outer wall will permit the air to escape from the curling chamber and will induce a more radial air flow from the elongate member to the outer wall. A more radial air flow is expected to be more effective in pushing a section of hair towards or against the outer wall. In embodiments in which the outer wall of the curling chamber is heated, more effectively pushing the hair into contact with the outer wall is expected to make the styling operation quicker and more consistent.

Desirably, the combined area of the perforations in the outer wall (plus the area of the primary opening through which air can also leave the chamber) exceeds the combined area of the perforations in the elongate member so that the perforations in the outer wall do not restrict the overall air flow through the curling chamber. The provision of a perforated outer wall, and in particular an outer wall with a larger area of perforations, helps to ensure that the air flow from the elongate member to the outer wall is largely radial, thereby assisting the outwards pushing of the section of hair and reducing the likelihood that any of the section of hair is pushed in an uncontrolled or undesired direction by the air flow.

In embodiments in which the outer wall is perforated, the movable abutment in its closed position can span all of the secondary opening so that very little (or substantially none) of the air leaves the curling chamber by way of the secondary opening during the styling operation. In embodiments in which the outer wall is not perforated, the movable abutment in its closed position preferably does not span all of the secondary opening; during use air leaves the chamber by way of the primary opening and also by way of the open portion of the secondary opening.

According to a second aspect of the invention there is provided a hair styling device having a body portion and a handle portion, the body portion having a curling chamber, the curling chamber having a rotatable element and an elongate member, at least part of the rotatable element and at least part of the elongate member being in the curling chamber, the curling chamber having an opening through which a section of hair can pass into the curling chamber, the rotatable element being located adjacent to the opening and being shaped to pull the section of hair through the opening, the rotatable element winding the section of hair around the elongate member in use, the handle portion having a pair of heating panels, the handle portion being separable from the body portion.

A hair styling device according to the second aspect shares certain features of the first aspect described above. In particular it shares the feature of a removable handle portion. Hair styling devices according to the second aspect can therefore be used as an automated hair curler (with the handle portion attached to the body portion), or as a hair straightener/smoother (with the handle portion detached).

According to a third aspect of the invention there is provided a hair styling device having a body portion, a handle portion and a curling chamber, the body portion having an air inlet and an air outlet, an impeller between the air inlet and the air outlet and an electric motor to rotate the impeller, the curling chamber having a rotatable element and an elongate member, at least part of the rotatable element and at least part of the elongate member being in the curling chamber, the curling chamber having an opening through which a section of hair can pass into the curling chamber, the rotatable element being located adjacent to the opening and being shaped to pull the section of hair through the opening, the rotatable element winding the section of hair around the elongate member in use, the body portion having a body connection part adjacent to the air outlet, the curling chamber having a chamber connection part which can cooperate with the body connection part whereby the curling chamber is removably attachable to the body portion, the curling chamber having a chamber air inlet adjacent to the chamber connection part, the chamber air inlet being in communication with the body air outlet when the curling chamber is attached to the body portion, the handle portion having a pair of heating panels, the handle portion being separable from the body portion.

A hair styling device according to the third aspect shares the features of the first and second aspects described above. Hair styling devices according to this aspect can be used as a hair dryer (with the handle portion attached to the body portion and without the curling chamber), as an automated hair curler (with the handle portion and the curling chamber attached to the body portion), or as a hair straightener/smoother (with the handle portion detached).

Preferably, for all of the described aspects the controller for each operation of the hair styling device is located wholly or partly in the handle portion. Preferably also, the hair styling device has a single electric power supply cable which is connected to the handle portion. Electric power is preferably transmitted to the body portion by way of cooperating electric connectors of the body portion and handle portion. Desirably the body portion has a number of projecting (or "male") electric connectors and the handle portion has a corresponding number of recessed (or "female") electric connectors.

The use of female electric connectors on the handle portion is preferred as those connectors can be made less exposed and therefore less accessible than male electrical connectors. This is particularly important when the handle portion is used alone and the electric connectors may be accessible to the user. Preferably, the handle portion has a cover for the electric connectors, the cover being movable to expose the connectors. In embodiments in which the body portion has a mounting structure as described above, it can be arranged that the cover moves to its open position automatically as the handle portion and the movable part are moved to their retained position. Conversely, the cover moves to its closed position automatically as the handle portion and the movable part are moved to their released position.

Desirably, at least some of the electric connectors are provided to permit the controller (of the handle portion) to transmit control signals to, and to receive control information from, the body portion. The user can thereby actuate and control the electric motor(s) of the body portion (for example) by way of control switches on the handle portion. The user can therefore control the hair dryer functions, including in some embodiments adjusting the temperature and/or the flow rate of heated air through the body portion, by way of control switches on the handle portion. Similarly, the user can control the hair curler functions, and in some embodiments can adjust the temperature of the heating elements of the curling chamber, by way of control switches on the handle portion.

Notwithstanding that the main control for the body portion is preferably provided by a controller in the handle portion, it is not excluded that some of the control functions for the body portion are undertaken by a secondary controller in the body portion (where space is typically less limited).

In hair styling devices according to the third aspect in which a curling chamber is removably attachable to the body portion, cooperating electric connectors of the body portion and the curling chamber can be provided to communicate power and/or control signals and information between the body portion and the curling chamber. The electric connections can be located adjacent to the body connection part and the chamber connection part; preferably also the electric connections can be automatically connected when the curling chamber is attached to the body portion by way of the cooperating connection parts. The electric connectors preferably provide power and control to the rotatable element and also to a movable abutment, to one or more sensors, and to load detection circuitry, such as those described in WO 2012/080751.

Notwithstanding the possibility to provide electric power to the curling chamber to drive a (second) motor for the rotatable element, it can alternatively be arranged that the second motor is in the body portion. Alternatively again, the rotatable element could be driven to rotate by way of the air flow generated by the impeller of the body portion, as is proposed in WO 2009/077747.

To avoid unnecessary repetition, each feature described in relation to a hair styling device according to one aspect of the invention can be incorporated into a hair styling device according to any other aspect with which it is compatible.

Notwithstanding the multifunctional nature of the present device, the inventors have sought to provide a device in which the separate functions are not compromised, i.e. {i} the device when used as a hair dryer is at least as easy to use and as effective as a conventional hair dryer, {ii} the device when used as a hair straightener is at least as easy to use and as effective as a conventional hair straightener, and {iii} the device when used as an automated hair curler is at least as easy to use and as effective as a conventional automated hair curler.

BRIEF DESCRIPTION OF THE PREFERRED EMBODIMENTS

The invention will now be described in more detail, by way of example, with reference to the accompanying drawings, in which.

DETAILED DESCRIPTION

Figure 1:
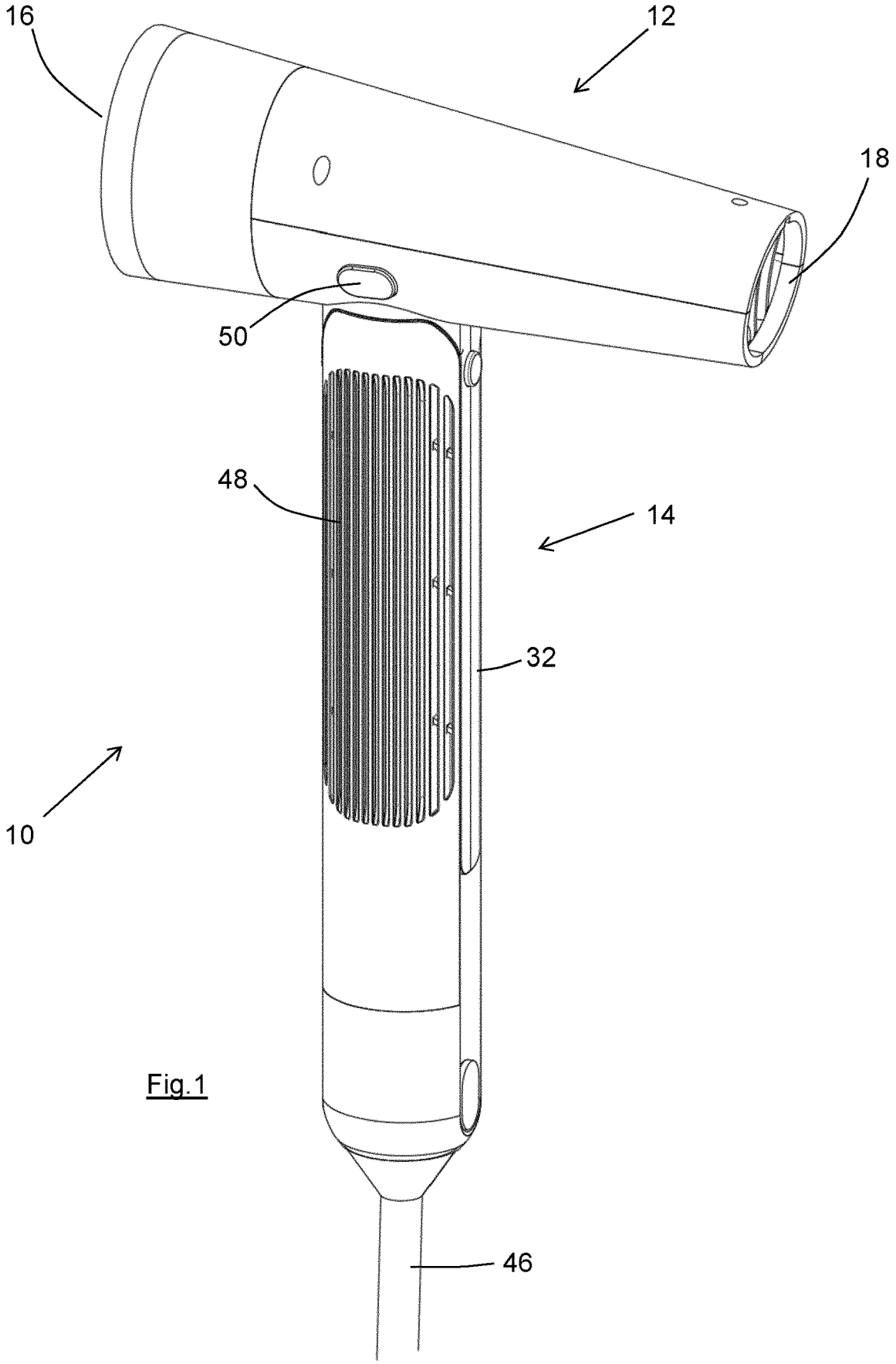
FIG. 1 shows a perspective view of a hair styling device according to the first aspect of the present invention, with the handle portion attached to the body portion.

The hair styling device 10 has a body portion 12 and a handle portion 14. In common with a conventional hair dryer the body portion 12 has an air inlet 16 and an air outlet 18. An impeller and an electric motor to rotate the impeller (not seen) are mounted in the body portion 12 between the air inlet 16 and the air outlet 18.

Figure 3:
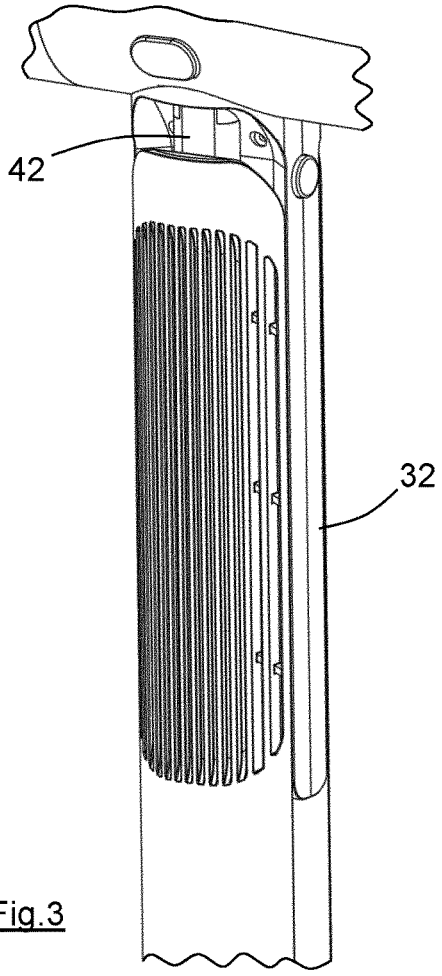
FIG. 3 shows a partial view of the handle portion and the body portion with the handle portion in its released position.

The air can be heated as it flows from the air inlet 16 to the air outlet 18. In this embodiment the heat is provided by an electric heating element (not seen) inside the body portion. In other embodiments the heating panels 20 of the handle portion 14 (one of which is seen in FIG. 3) can provide some or all of the heat for the air.

The components and their layout inside the body portion 12 are not relevant to the present invention and may be entirely conventional. The body portion 12 is distinguished from a conventional hair dryer by the mounting structure 22 (FIG. 2) and by the handle portion 14 which is releasably mounted thereto, as explained in detail below.

Figure 10:
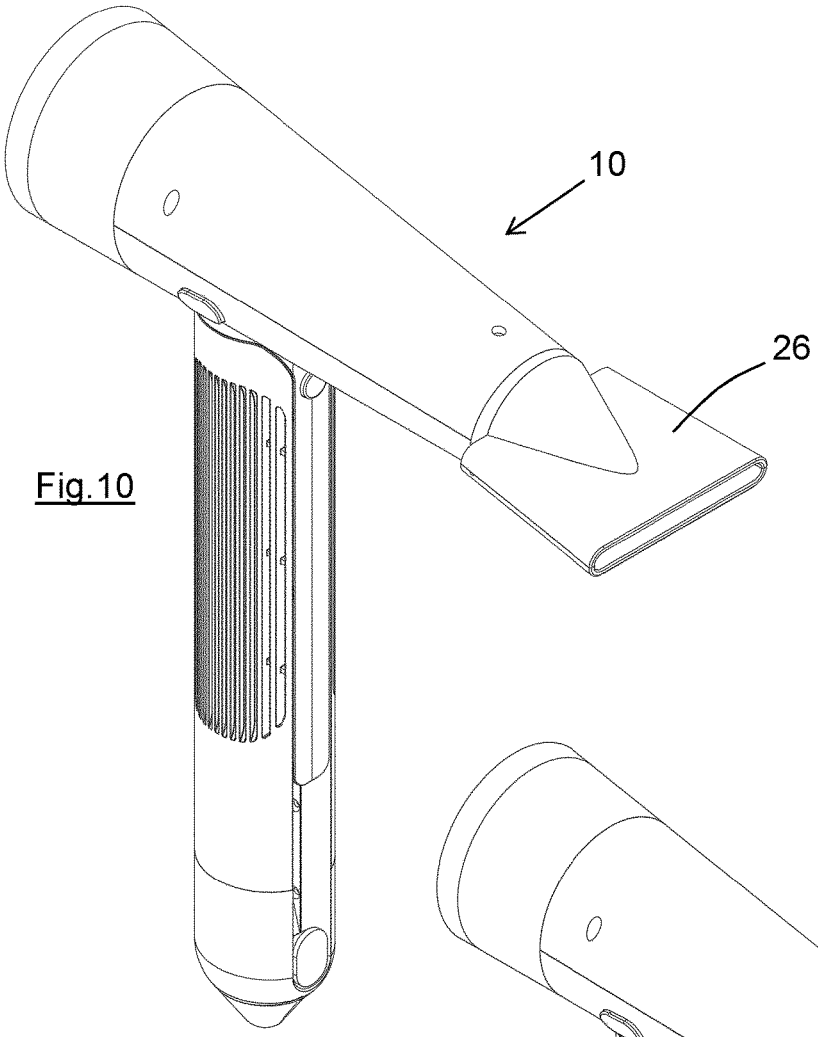
FIG. 10 shows the device of FIG. 1 fitted with a nozzle attachment.
Figure 11:
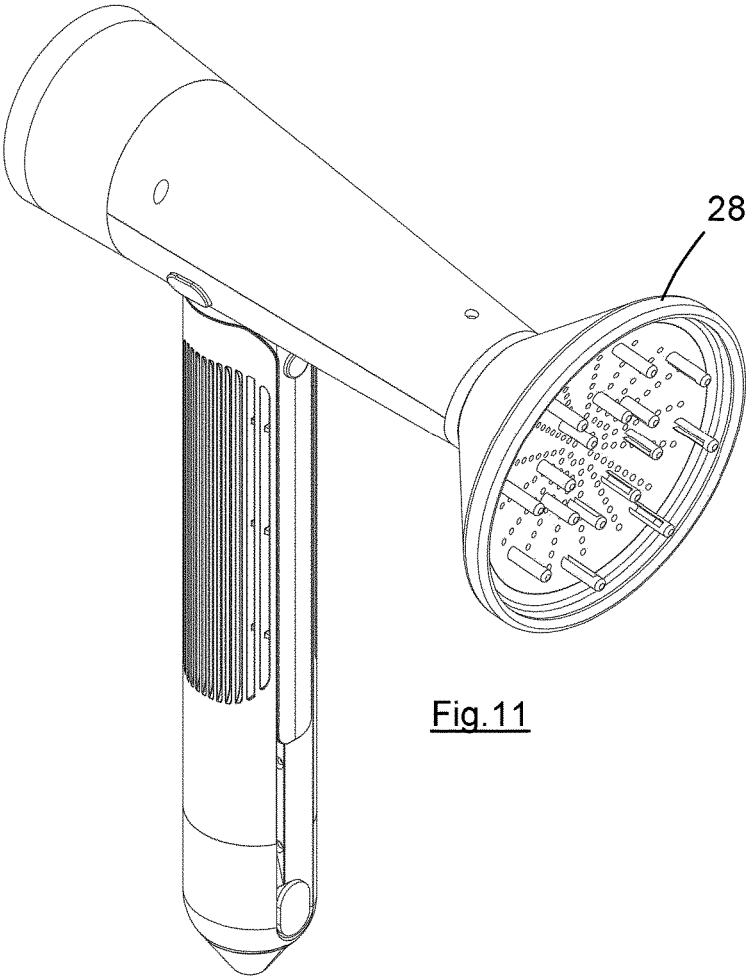
FIG. 11 shows the device of FIG. 1 fitted with a diffuser attachment.

The body portion 12 and the handle portion 14 can together be used similarly to a conventional hair dryer as is shown in FIG. 1. In this configuration the two arms 24 of the handle portion 14 provide the handle by which the user grips and manipulates the hair dryer. To further clarify the conventional structure of the hair dryer shown in FIG. 1, FIG. 10 shows an optional nozzle attachment 26 fitted at the air outlet 18 and which concentrates and directs the heated air flow. Also, FIG. 11 shows an optional diffuser attachment 28 fitted at the air outlet 18 to provide a more diffuse air flow.

Figure 2:
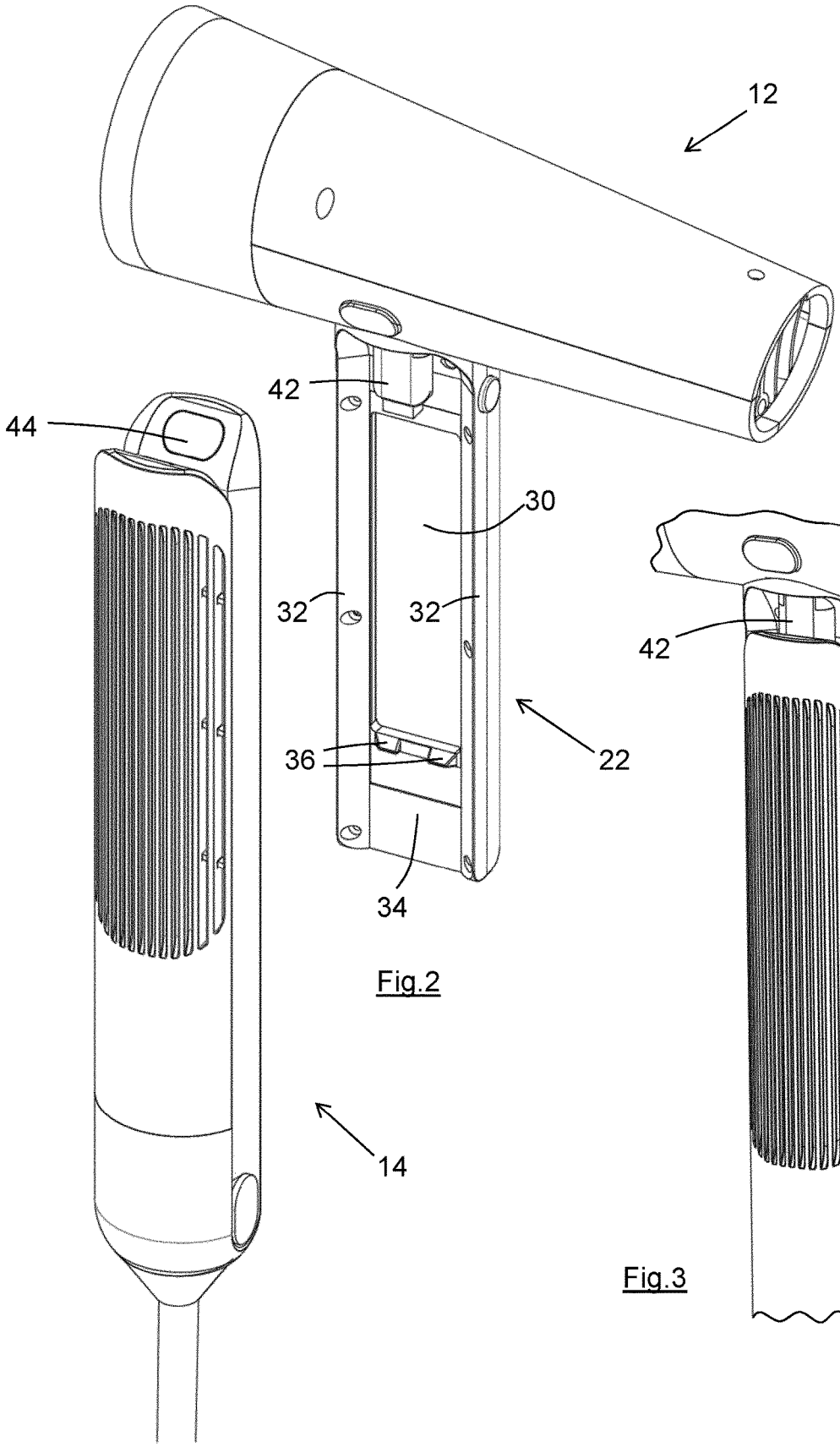
FIG. 2 shows a perspective view of the handle portion and body portion of the hair styling device of FIG. 1 with the handle portion detached from the body portion.

As shown in FIG. 2, the handle portion 14 may be separated from the body portion 12. In this embodiment the body portion 12 has a mounting structure 22 to which the handle portion may be releasably attached as described below, the mounting structure providing a substantially planar platform which projects from the remainder of the body portion.

The mounting structure 22 has an opening 30 which is sized and shaped to accommodate the heating panels 20 of the handle portion 14. It can be arranged that the heating panels 20 engage each other in the closed (and attached) condition shown in FIG. 1, or the heating panels can be held slightly apart by the mounting structure 22. In either case, the heating panels 20 lie within the opening 30 and the working surfaces of the heating panels (which in this case are planar) do not engage any part of the mounting structure. The avoidance of unnecessary contact with parts of the mounting structure is expected to minimise the likelihood of damage or wear to the heating panels 20.

At each side of the opening 30 the mounting structure 22 has a protective formation 32. The protective formations 32 are made of a material which is a poor conductor of heat but which is also able to withstand the very high operating temperatures of the heating panels 20. In this embodiment the protective formations are made of plastic, specifically PEEK, but any suitable high temperature plastic or composite material could be used. It will be seen in FIG. 1 that when the handle portion 14 is attached to the body portion 12 the protective formations 32 overlie and obscure the side edges of the heating panels 20, which side edges would otherwise be exposed and accessible. The protective formations 32 thereby reduce the likelihood of a user being burned by inadvertent contact with the side edges of the heating panels if the device is used as a hair dryer (for example) with the heating panels close to their operating temperature.

The protective formations 32 are continuous and extend beyond the ends of the opening 30 (and thereby beyond the ends of the heating panels) so as to overlie and obscure all of the side edges of the heating panels.

The protective formations 32 are fixed parts of the mounting structure 22, i.e. they are rigidly connected to the remainder of the body portion 12. The opening 30 is formed in a slide plate 34 which can move (in this embodiment slide) relative to the protective formations 32 and other fixed parts of the mounting structure 22.

Figure 4:
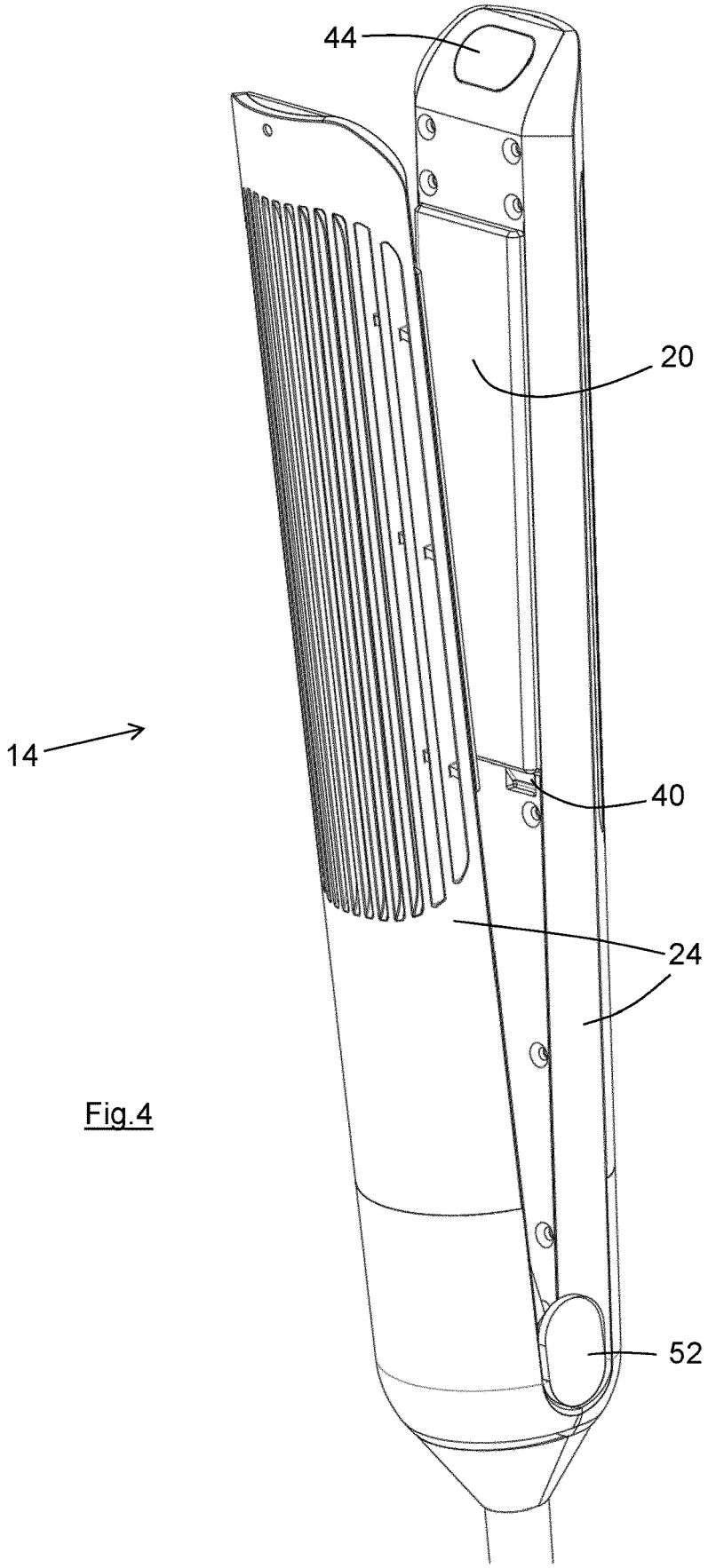
FIG. 4 shows a perspective view of the handle portion alone, with the arms in their open condition.

The slide plate 34 has two cooperating formations in the form of projections 36 which are upstanding from the remainder of the slide plate 34. As seen in FIG. 4 an arm 24 of the handle portion 14 has cooperating formations in the form of recesses 40 (only one of which can be seen) which can accommodate the respective projections 36. If desired, both of the arms 24 can have identical recesses 40 so that the handle portion 14 can fit to the mounting structure in either of two ways. It is not necessary that the slide plate 34 has corresponding projections 36 upstanding to both sides but that is not excluded.

To attach the handle portion 14 to the body portion 12, the arms 24 of the handle portion 14 are separated as shown in FIG. 4 and the respective heating panels 20 are passed to either side of the mounting structure 22 until the panels overlie the opening 30. The arms 24 are pressed together which causes the projections 36 to enter the recesses 40 and the heating panels 20 to enter the opening 30, as is shown in FIG. 3. From the released position shown in FIG. 3 the handle portion 14 is moved upwardly to the retained position shown in FIG. 1, during which movement the slide plate 34 (and consequently the projections 36 and the opening 30) move (upwardly from the position as drawn in FIG. 2) with the handle portion 14.

FIG. 2 shows the housing 42 for the electric connectors of the body portion 12. FIG. 2 also shows a cover 44 which obscures the electric connectors (not seen) of the handle portion 14. The cover 44 is movable, and specifically is hinged to the remainder of the arm 24, the cover being resiliently biased to the closed position as shown. The cover 44 spans an opening in the arm 24, the opening being sized to accommodate the housing 42.

As seen in FIG. 3, in the released position the housing 42 is spaced slightly from the arm 24 and so the cover 44 remains closed in that position. It is arranged that sliding movement of the handle portion 14 from the released position of FIG. 3 to the retained position of FIG. 1 causes the housing 42 to push open the cover 44 and enter the opening. Movement of the handle portion 14 to the retained position causes the electric connectors of the handle portion 14 to contact the electric connectors of the body portion 12.

Notwithstanding the cover 44, in this embodiment the handle portion 14 has female electric connectors and the body portion 12 has male electric connectors so as to reduce the likelihood that a user could open the cover 44 with a finger or tool and engage an electric connector.

Though not shown in the drawings, both of the arms 24 have electric connectors beneath a respective cover 44, and a housing 42 for cooperating electric connectors of the body portion 12 is located to both sides of the platform of the mounting structure 22.

Whilst it would be possible for the device to be battery powered, it will be seen from FIG. 1 that in this embodiment the electrical supply is connected by way of a mains cable 46 to the handle portion 14. The electrical supply to the body portion 12 to drive the impeller and to actuate the heating element is therefore communicated from the handle portion 14 by way of the cooperating electric connectors. In the simplest embodiments the impeller and heating element are actuated by attachment of the handle portion 14 to the body portion 12. It is preferred, however, that the electric connectors also communicate control signals to the body portion, including for example control signals to switch the impeller and heating element on and off, and perhaps also to adjust the speed of the impeller and to adjust the temperature of the heating element. Control information can also be communicated from the body portion to the handle portion, for example a temperature sensor in the body portion 12 can communicate with the controller in the handle portion 14 to switch off the heating element if a predetermined maximum temperature is reached.

The handle portion 14 is secured in the retained position of FIG. 1 by way of a latch mechanism. The structure of the latch mechanism is not shown in the drawings because the structure is not essential for the invention to be performed. Also, a skilled person would readily be able to incorporate a suitable latch mechanism in a suitable location. The latch mechanism automatically actuates to secure the handle portion 14 when the handle portion 14 is pressed into the retained position of FIG. 1. Preferably, the latch mechanism operates between the fixed part and the movable part of the mounting structure 22 so that it is not necessary for the latch mechanism to engage any part of the handle portion 14.

To release the latch mechanism it is necessary for the user to press two opposing buttons 50 together, only one of which buttons is shown in FIGS. 1 and 2. The requirement to press two buttons together reduces the likelihood that the handle portion 14 is inadvertently released.

As can be seen from FIG. 4, the handle portion 14 is formed very similarly to a conventional hair straightener in that the pair of arms 24 are connected by hinge 52 at one end of the arms, with the heating panels 20 at the other end of the arms. Also in conventional fashion the arms 24 are resiliently biased apart to the open condition of FIG. 3. During use as a hair straightener the arms 24 are pressed together by the user in known fashion, with the user's hand passing around both the arms 24 adjacent to the hinge 52 and with a section of hair passing between the heating panels 20.

As above indicated, in this embodiment the handle portion 14 can be attached to the mounting structure 22 in one of two ways. This avoids the user having to check the location of the projections 36 and recesses 40 and to orient the handle portion 14 accordingly each time the handle portion is attached to the body portion 12. The electric connectors on both of the arms 24, and the electric connectors in both of the housings 42, must therefore be identical, and connected to the same componentry, so that the device can operate regardless of the attached orientation of the handle portion. In an alternative embodiment only one of the arms 24 has recesses 40, and projections 36 are upstanding from only one side of the platform of the mounting structure 22, so that the user has to correctly orient the handle portion 14 relative to the mounting structure 22. In such embodiments the electric connectors for one arm 24 can differ from the electric connectors of the other arm 24 and the respective electric connectors can be connected to different componentry of the body portion 12.

When the handle portion 14 is being attached to the body portion 12 the arms 24 are pressed together by the user to hold the arms in contact with the mounting structure and to move the handle portion into the retained position of FIG. 1. In the retained position the housings 42 are located in the openings underneath the covers 44 and the arms 24 and are thereby held together against the resilient bias.

As above stated, during use the user will normally grip the handle portion 14 adjacent to the hinge 52. It is expected that the user will similarly grip the handle portion 14 during attachment to the body portion 12. Notwithstanding an operating temperature of the heating panels of 200° C. of higher, the arms 24 can comfortably be gripped adjacent to the hinge because of the poor thermal conductivity of the arms and the distance between the heating panels 20 and the region which is gripped. In the attached position as shown in FIG. 1, however, it is expected that the handle portion will be gripped in a region farther from the hinge, and in particular a region directly overlying at least a part of a heating panel 20.

Since the handle portion 14 may on occasions be attached to the body portion 12 with the heating panels 20 close to their operating temperature, the covering parts 48 of the arms (i.e. those parts of the arms which directly overlie the heating panels 20), have surface deformations, in this embodiment longitudinal ribs, so as to increase the surface area and thereby increase the dissipation of heat to the environment. The temperature of the covering parts 48 can thereby be reduced to make the arms 24 more comfortable to grip.

The heating panels 20 are preferably heated electrically by way of ceramic heaters in known fashion. Electric power is provided to the heaters by way of the power supply cable 46. In known fashion, one of the arms 24 has a controller (not seen) and control switches which are accessible to the user and by which the user can switch the power to the heating panels 20 on and off and can set the temperature of the heating panels 20. It can if desired be arranged that the heaters for the heating panels 20 are automatically switched off when the handle portion 14 is attached to the body portion 12 (although the user is expected normally to switch off the heaters before attempting to attach the handle portion). For example, the controller of the handle portion 14 can be configured to recognise when the electric connectors of the handle portion 14 and body portion 12 are connected and can switch off the power to the heaters if the user has not already done so.

In this embodiment the heating panels 20 are planar and can be pressed together so as to press the hair as it passes therebetween, with the pressure applied to the hair being determined by the user's grip upon the arms 24, as with conventional hair straighteners. In alternative embodiments the heating panels can be corrugated, and in yet other embodiments the heating panels 20 can be held slightly apart in their closed condition, to better provide the desired styling.

In an alternative embodiment the upper end (as viewed) of the handle portion may enter a recess in the body portion so that in the attached condition at least part of the heating panels lie inside the body portion. It can be arranged that the heating panels lie in the air path between the air inlet and the air outlet with a small gap therebetween which is sufficient to allow air to pass between the panels on its path from the air inlet to the air outlet. Accordingly, the heating panels of the handle portion act to heat the air as it passes through the body portion, perhaps instead of or in addition to separate or additional heating elements in the body portion.

Figure 5:
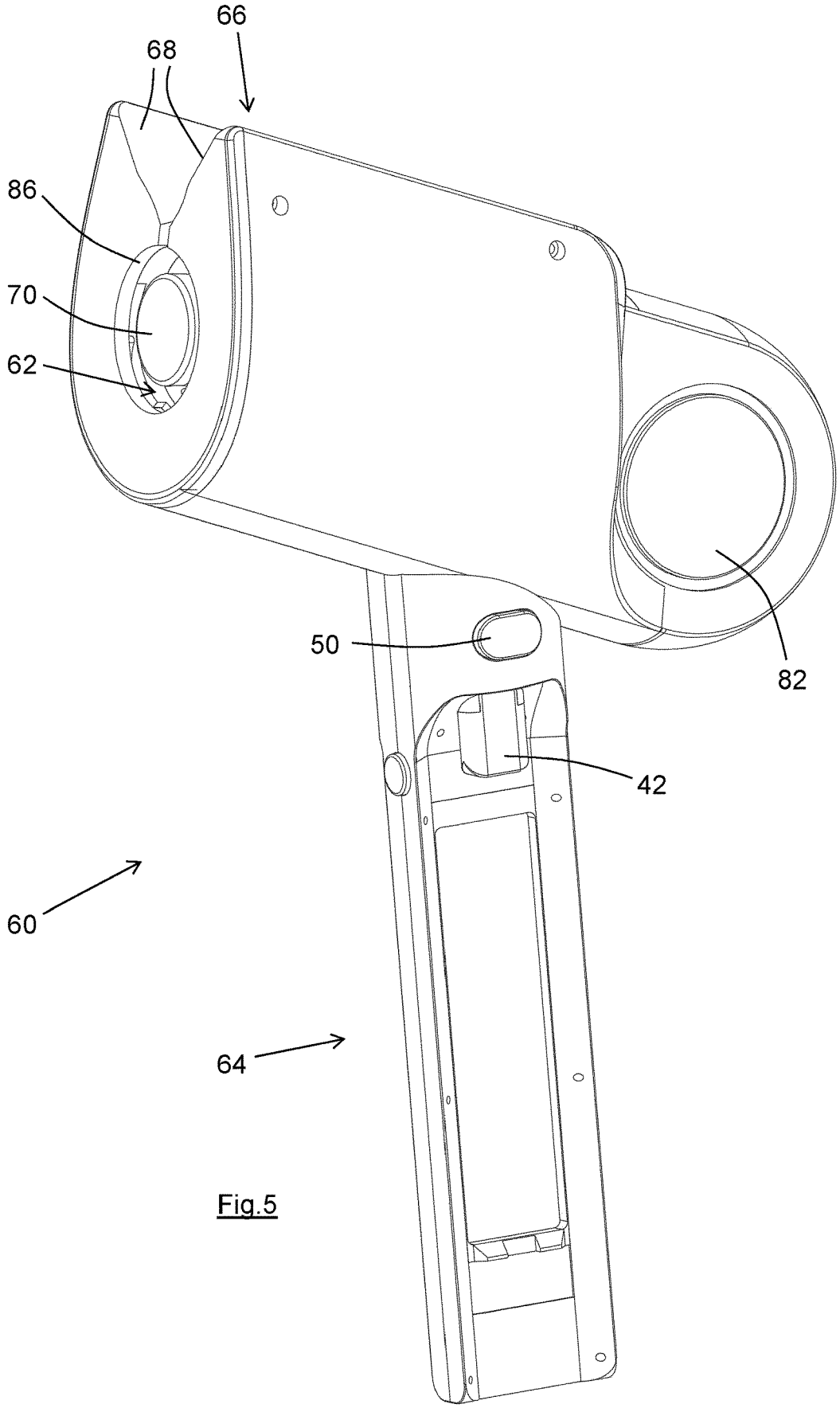
FIG. 5 shows a perspective view of a body portion of a hair styling device including a curling chamber.

FIG. 5 shows the body portion 60 of an alternative hair styling device which includes a curling chamber 62. The handle portion is not shown in FIG. 5 but it will be seen that the body portion 60 has a mounting structure 64 which is substantially identical to the mounting structure 22. The handle portion 14 of FIG. 3 can therefore be attached to and released from the body portion 60 in the same way as is described above for the body portion 12. As regards the attachment of the handle portion 14, the only significant differences between the respective body portions 12 and 60 are that the mounting structure 64 is slightly longer than the mounting structure 22 and that the buttons 50 to release the latch mechanism are outside the housing of the body portion 60. These differences are incidental and arise only because in practical embodiments there is less space to accommodate the latch mechanism inside the housing of the body portion 60 than inside the housing of the body portion 12.

In common with the known automated hair curlers, the body portion 60 has a primary opening 66 (see also FIGS. 7 and 9) through which a section of hair can pass into the chamber. The body portion 60 in this embodiment has angled guides 68 which converge towards the primary opening 66 and which assist the user in correctly positioning the section of hair adjacent to the primary opening.

Figure 6:
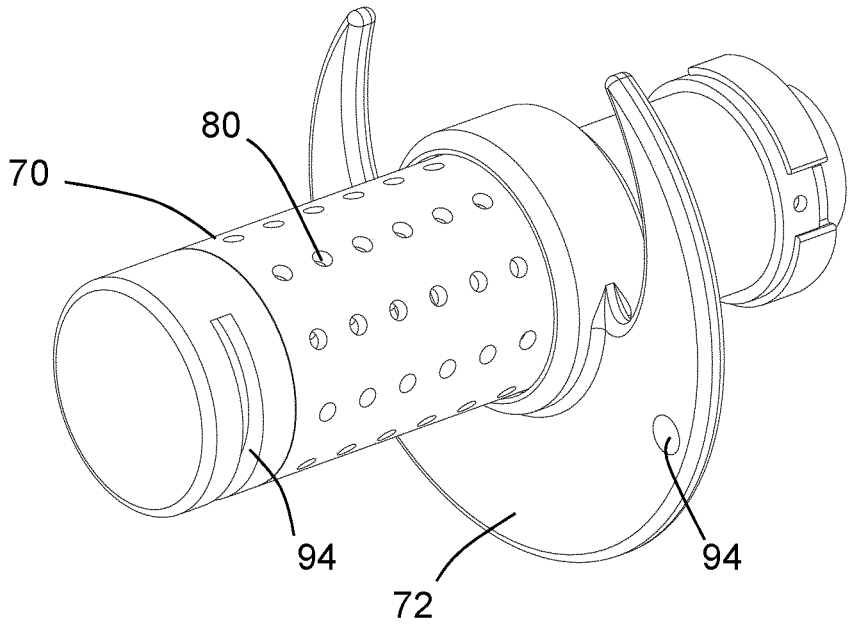
FIG. 6 shows a perspective view of the elongate member and rotatable element which are located in the curling chamber.

Inside the curling chamber are an elongate member 70 and a rotatable element 72, as seen in FIG. 6. The rotatable element 72 extends beyond the primary opening 66 (and specifically rotates inside the annular sub-chamber 74 shown in FIG. 7). The rotatable element 72 lies alongside the elongate member 70 and in use engages the section of hair adjacent to the primary opening 66 and pulls the section of hair into the curling chamber 62 between the elongate member 70 and the outer wall 76. The detailed structure of the rotatable element 72 and the way in which it pulls the section of hair into the chamber and winds a section of hair around the elongate member in use is described in detail in WO 2009/077747 and WO 2012/080751 and it is not necessary to repeat that description in this application. In this embodiment the shape of the rotatable element 72 is similar to one of the embodiments shown and described in those prior art documents but it will be understood that alternative shapes could be used.

As is described in WO 2009/077747 in particular, at the end of a curling operation a section of hair is wound around the elongate member 70 in the curling chamber 62.

In this embodiment the elongate member 70 is perforated and the openings or perforations 80 are in communication with the air inlet 82. The body portion 60 includes an impeller and a continuous air path is formed from the air inlet 82 to the perforations 80 of the elongate member 70.

Figure 7:
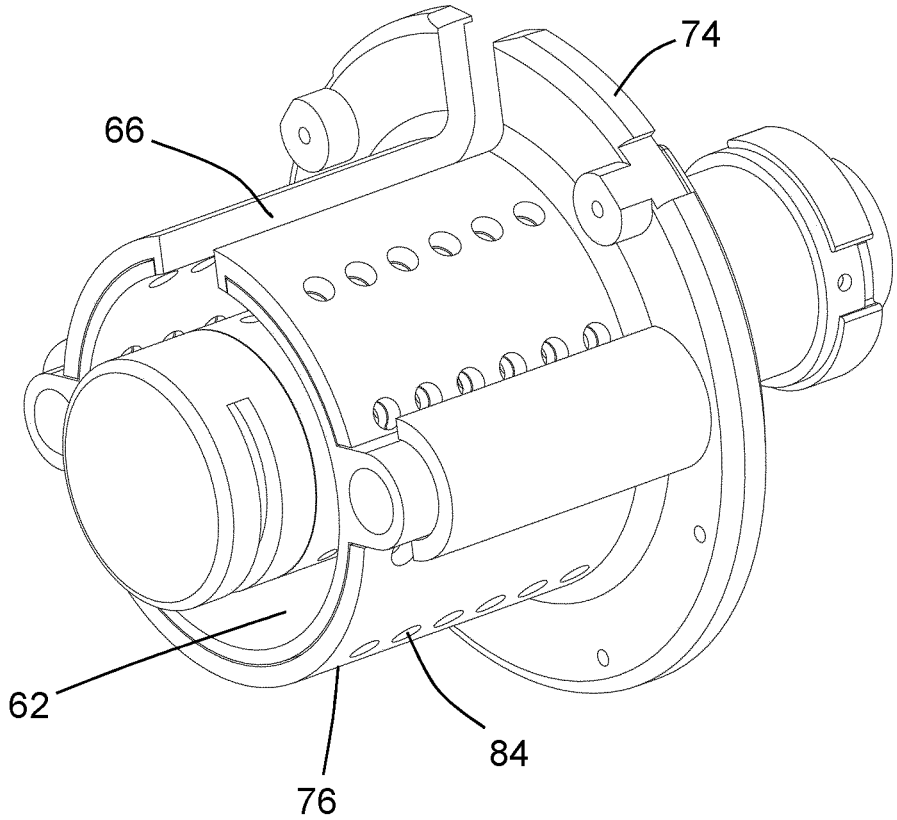
FIG. 7 shows a perspective view as FIG. 6 but including also the outer wall of the chamber.

As seen in FIG. 7, the outer wall 76 of the curling chamber 62 is also perforated whereby air can pass out of the curling chamber by way of the openings or perforations 84. The combined area of the perforations 84 and the primary opening 66 in the outer wall 76 is significantly larger than the combined area of the perforations 80 of the elongate member 70. The outer wall 76 therefore does not substantially restrict the air flow with the result that air can flow from the perforations 80 in the elongate member 70 in a substantially radial direction through the curling chamber 62 and out through the outer wall 76. That air flow will act to drive a coiled section of hair away from the elongate member 70 and against the outer wall 76. Pushing a coiled section of hair outwardly towards or against the outer wall 76 as it is styled can help to create more consistent curls in the styled sections of hair (whether or not the outer wall 76 is directly heated).

The provision of substantially radial air flow in the curling chamber 62 is beneficial for a styling operation upon dry hair and also upon damp hair. In both cases the air is preferably heated by a heating element in the body portion 60 so as to heat (and dry, as applicable) the section of hair, it being recognised that the application of heat will assist the styling operation. Alternatively, the air blown through the perforations 80 can be substantially at ambient temperature and the hair can be heated by way of heating elements in the outer wall 76 and/or in the elongate member 70 (or the hair can be heated by a combination of these methods).

FIG. 7 shows that the outer wall 76 is part-circular in cross-section and therefore comprises a single continuous surface. It is appropriate to refer to a single outer wall in this embodiment but it should be understood that in alternative embodiments the outer wall could comprise separate curved sections. The term "outer wall" should therefore be interpreted throughout this application as a single continuous component or as multiple separate components which together provide the outer wall of the curling chamber.

As with the hair dryer of FIG. 1, it is a preferable feature of the hair curler of the present invention that electric power and control signals are provided to the body portion 60 from the handle portion 14, the body portion 60 including a housing 42 for electric connectors. This results in a device comprising separable components which nevertheless require only a single electric power cable and a single set of user switches. This also simplifies the structure of the body portion 60 since the body portion does not require its own power supply and is not able to operate without the attached handle portion 14.

The common housings 42 for the electric connectors enables the same handle portion 14 to be attached to the body portion 12 (for hair drying) and to the body portion 60 (for hair curling and/or hair drying/curling).

Figure 8:
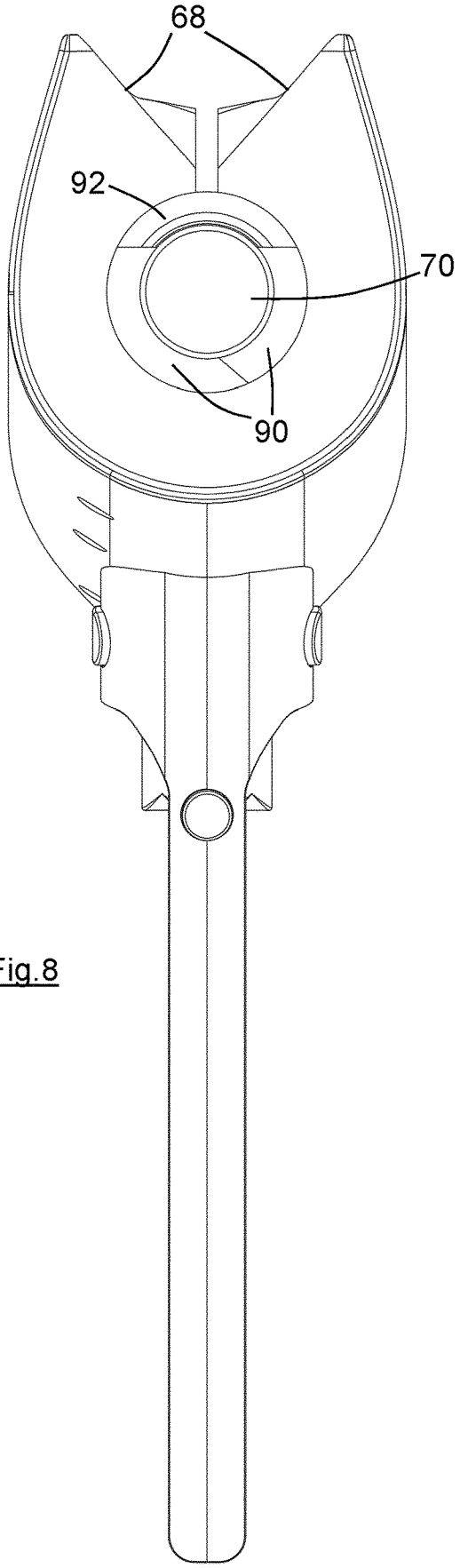
FIG. 8 shows a front view of the body portion of FIG. 5 with the movable abutment in its closed position.
Figure 9:
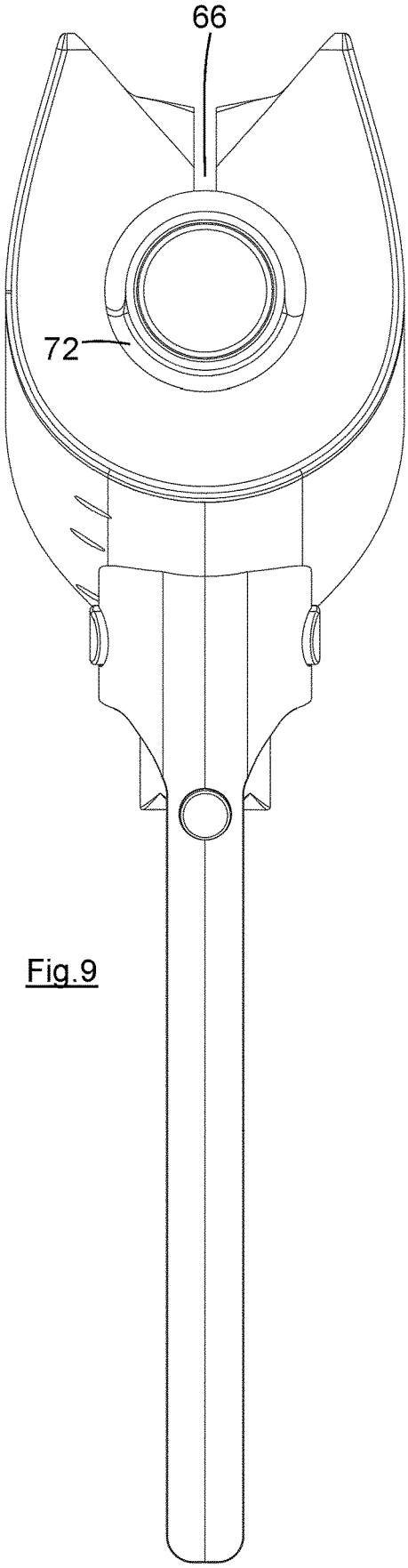
FIG. 9 shows a view as FIG. 8 but with the movable abutment in its open position.

FIGS. 8 and 9 show front views of the body portion 60 in two different operational states. It will be seen from FIGS. 5,6 and 7 that the elongate member 70 has a free end and the curling chamber has a secondary opening 86 surrounding the free end. Whilst FIG. 5 shows the free end of the elongate member approximately aligned with the end of the curling chamber 62 that is not necessary and in other embodiments the elongate member can extend beyond or can terminate within the curling chamber. As is explained in WO2012/080751, the free end surrounded by a secondary opening enable a curled length of hair to slide along and off the elongate member 70 at the end of a curling operation with the minimum loss of the formed curl.

To prevent the section of hair simply being twisted around the elongate member, and to retain the length of hair in the curling chamber, as the rotatable element rotates, a movable abutment is located adjacent to the free end of the elongate member 70. In addition to the above functions, the movable abutment 90 in this embodiment additionally functions to close off a large proportion of the secondary opening 86 so as to reduce the passage of air through the secondary opening during the styling operation. FIG. 8 shows the movable abutment 90 in its closed position and FIG. 9 shows the movable abutment in the open position (the movable abutment cannot be seen in FIG. 9 as it has been retracted into the body portion 62 surrounding the free end of the elongate member.

To close more of the secondary opening the movable abutment 90 in this embodiment is formed in two separate parts and in alternative embodiments can be formed in more than two parts if desired. As seen in FIG. 8 the movable abutment does not close all of the secondary opening and a portion 92 remains open. In this embodiment the movable abutment 90 in its closed position covers approximately 70%, and the portion 92 comprises approximately 30%, of the area of the secondary opening 86.

It has been found that the rate of air flow through the open portion 92 is relatively slow and the open portion 92 does not prevent the desired substantially radial air flow from the perforations 80 to the perforations 84. Nevertheless, in alternative embodiments all (or substantially all) of the secondary opening 86 can be closed by the movable abutment if desired (for example by using multiple components similar to a camera shutter).

FIGS. 6 and 7 show a part-annular groove 94 adjacent to the end of the elongate member 70 and it is arranged that the movable abutment 90 enters the groove 94 in its closed condition. Whilst that is a preferable feature to help prevent any of the hairs in the section of hair from passing the movable abutment, it is not essential and in any event the movable abutment 90 does not need to engage any part of the elongate member 70.

The electric motor in the body portion 12 which rotates the impeller, and the electric motor(s) in the body portion 60 which rotate the impeller and the rotatable element 72 can be controlled totally from the controller in the handle portion 14 if desired. However, there is significantly more space to mount the printed circuit board (PCB) for the motor in the body portion 12/60 than in the handle portion 14 and it is expected that a separate PCB to control the motor(s) will be mounted in the body portion 12/60. The controller in the handle portion 14 is expected to have its own PCB which can communicate with the PCB in the body portion 12/60. Accordingly, all of the control functions for the hair straightener will be provided by the handle portion 14 whereas at least some of the control functions for the hair dryer and for the hair curler can be provided by the body portion 12/60. In any event, however, all of the user-actuatable controls for the hair dryer and the hair curler are mounted on the handle portion 14.

As above stated, it would be possible for a single motor in the body portion 60 to drive the impeller and also to drive the rotatable element 72. That is not preferred, however, firstly because of the significantly differing rotational rates of the impeller and rotatable element. Also, two separate motors allow the motor for the rotatable element to be stopped when all of the section of hair has been wound around the elongate member and the motor for the impeller to stop later on when the styling operation is complete.

The structure of the mechanical and electrical connections between the handle portion 14 and the body portion 12 is not critical to the present invention and many alternative structures to those which have been described can be used. In addition, the detailed structure and location of the electric connectors for power, and for control and/or information is also not critical to the invention and many different variants could be used.

In an alternative embodiment according to the second aspect of the invention, and which is not shown in the drawings, the curling chamber does not incorporate air flow. Accordingly, the body portion has a curling chamber but without an air inlet and without an impeller (and heater) for the air. Also, the elongate member and outer wall are not perforated. According to this aspect the device can comprise a handle portion 14 which can be releasably attached to a body portion having a curling chamber similar to the curling chamber described in WO2009.077747 or WO 2012/080751 for example.

It is preferably arranged that the rotatable element 72 should undertake a number of complete revolutions in each styling operation; the rotatable element 72 has a magnet 94 and a Hall effect sensor or the like can be used to detect the rotations of the rotatable element and communicate that to the controller so that the motor for the rotatable element can be activated and deactivated appropriately. Also, as described in WO 2012/080751, entanglement of the section of hair can be detected by an unexpected reduction in the rate of rotation of the motor driving the rotatable element, or by an increase in the electrical current drawn by that motor, both of which can be communicated to the controller to stop (and reverse) the rotatable element 72 as desired. If the body portion 60 has sensors to detect misplaced hair those sensors can communicate with the controller to prevent rotation of the rotatable element until the misplaced hair is removed.

The invention claimed is:

1. A hair styling device having a body portion and a handle portion, the body portion having an air inlet and an air outlet, an impeller between the air inlet and the air outlet and an electric motor to rotate the impeller, the handle portion having a pair of heating panels, each heating panel having one or more electrical heating element(s), the handle portion being separable from the body portion, the body portion having at least one heating element which is separate from the heating panels, in which the heating panels are mounted to respective arms which can move towards and away from each other.

2. A hair styling device according to claim 1 in which the handle portion has two substantially planar heating panels.

3. A hair styling device according to claim 1, in which the arms are connected together by way of a hinged joint, and in which the hinged joint is located adjacent to an end of the handle portion.

4. A hair styling device according to claim 1 in which the handle portion has respective covering parts which cover the heating panels, and in which each covering part has a number of surface deformations which act to dissipate heat.

5. A hair styling device according to claim 4 in which the surface deformations are elongate ribs in the covering part.

6. A hair styling device according to claim 1 in which the body portion has a mounting structure to which the handle portion can be attached.

7. A hair styling device according to claim 6 in which the mounting structure comprises a generally planar platform projecting from the remainder of the body portion.

8. A hair styling device according to claim 6 in which the mounting structure has at least one protective formation which covers a part of a side edge of the heating panels when the handle portion is attached to the body portion.

9. A hair styling device according to claim 6 in which the mounting structure has an opening which is sized and shaped to accommodate the heating panels.

10. A hair styling device according to claim 9 in which the mounting structure has at least one protective formation which covers a part of a side edge of the heating panels when the handle portion is attached to the body portion, and in which the protective formation is located adjacent to a side of the opening.

11. A hair styling device according to claim 10 in which the protective formation is continuous and extends beyond the ends of the heating panels when the handle portion is attached to the body portion.

12. A hair styling device according to claim 6 in which the mounting structure comprises a fixed part and a movable part, the fixed part being fixed relative to the remainder of the body portion and the movable part being movable relative to the fixed part.

13. A hair styling device according to claim 12 in which the mounting structure has an opening which is sized and shaped to accommodate the heating panels, and in which the opening is located in the movable part.

14. A hair styling device according to claim 12 in which the movable part of the mounting structure and the handle portion have cooperating formations to ensure that these elements move together.

15. A hair styling device according to claim 14 in which the cooperating formations comprise at least one projection and at least one recess which can accommodate the projection.

16. A hair styling device according to claim 1 in which the handle portion is secured to the body portion by a latch mechanism.

17. A hair styling device according to claim 16 in which the body portion has a mounting structure to which the handle portion can be attached, in which the mounting structure comprises a fixed part and a movable part, the fixed part being fixed relative to the remainder of the body portion and the movable part being movable relative to the fixed part, and in which the latch mechanism includes a latch member which is mounted on the fixed part of the mounting structure and which can releasably engage the movable part of the mounting structure.

18. A hair styling device according to claim 1 in which, when the handle portion is attached to the body portion, the heating panels are located outside the body portion.

19. A hair styling device according to claim 1 in which the body portion has a curling chamber, the curling chamber having a rotatable element and an elongate member, at least part of the rotatable element and at least part of the elongate member being in the curling chamber, the curling chamber having a primary opening through which a section of hair can pass into the chamber, the rotatable element being located adjacent to the opening and being shaped to pull the section of hair through the opening in use, the rotatable element winding the section of hair around the elongate member in use, air in use flowing from the air inlet to the air outlet by way of the curling chamber.

20. A hair styling device according to claim 19 in which the curling chamber has a secondary opening through which the section of hair can pass out of the curling chamber, and in which the elongate member has a free end.

21. A hair styling device according to claim 20 in which a movable abutment is located adjacent to the free end and to the secondary opening, the movable abutment having a closed position in which the section of hair is retained in the curling chamber and an open position in which the section of hair can move off the free end of the elongate member and pass out of the curling chamber.

22. A hair styling device according to claim 21 in which the movable abutment spans at least 50% of the area of the secondary opening.

23. A hair styling device according to claim 19 in which the electric motor to rotate the impeller is a first electric motor and the body portion has a second electric motor to rotate the rotatable element.

24. A hair styling device according to claim 19 in which air enters the curling chamber by way of a number of openings or perforations in the elongate member.

25. A hair styling device according to claim 24 in which the outer wall of the curling chamber is also perforated, and in which the combined area of the perforations in the outer wall plus the area of the primary opening exceeds the combined area of the perforations in the elongate member.

26. A hair styling device according to claim 1 in which the handle portion has a controller and user-actuatable controls for the heating panels, and a controller and user-actuatable controls for the electric motor(s) in the body portion.

* * * * *